US005649809A

United States Patent [19]

Stapelfeldt

[11] Patent Number: 5,649,809

[45] Date of Patent: Jul. 22, 1997

[54] CRANKSHAFT AND PISTON ROD CONNECTION FOR A DOUBLE DIAPHRAGM PUMP

[75] Inventor: Volker Stapelfeldt, Ratzeburg, Germany

[73] Assignee: Abel GmbH & Co. Handels-und Verwaltungsgesllschaft, Buchen, Germany

[21] Appl. No.: 564,437

[22] Filed: Nov. 29, 1995

[30] Foreign Application Priority Data

Dec. 8, 1994 [DE] Germany ..... 44 43 778.1

[51] Int. Cl.[6] ..... F04B 43/02

[52] U.S. Cl. ..... 417/63; 417/413.1; 417/534; 417/536; 92/100; 92/138; 74/50

[58] Field of Search ..... 417/63, 415, 534, 417/535, 536, 537, 413.1; 92/138, 99, 100, 80, 168, 165 R; 74/50

[56] References Cited

U.S. PATENT DOCUMENTS

| | | | |
|---|---|---|---|
| 1,397,914 | 11/1921 | Augustin et al. | 417/535 |
| 1,445,844 | 2/1923 | Mueser | 92/99 |
| 2,063,728 | 12/1936 | De Ville | 417/413.1 |
| 3,172,369 | 3/1965 | Ballu | 417/537 |
| 5,114,321 | 5/1992 | Milburn et al. | 417/534 |

FOREIGN PATENT DOCUMENTS

| | | |
|---|---|---|
| 23 55 109 | 5/1974 | Germany . |
| 32 06 242 A1 | 9/1983 | Germany . |
| 33 11 104 A1 | 9/1984 | Germany . |
| 84 32 204.5 | 7/1985 | Germany . |
| 35 29 978 A1 | 3/1987 | Germany . |

OTHER PUBLICATIONS

*"Membranpumpen Typ Wiking M"* of the firm ABEL®; Jul. 1986.

*Primary Examiner*—Timothy S. Thorpe
*Assistant Examiner*—Roland G. McAndrews, Jr.
*Attorney, Agent, or Firm*—Vidas, Arrett, & Steinkraus, P.A.

[57] ABSTRACT

The invention relates to a double diaphragm pump having flexible diaphragms disposed in displacement spaces and connected and mechanically coupled to piston rods, the displacement spaces being communicated via check valves to a suction manifold on the one hand and to a pressure manifold on the other hand, wherein each diaphragm is connected to a piston rod, which piston rods extend coaxially and are mounted on opposite sides to a guide frame having at least one lineal guide for a guide block which rotatably mounts a crank pin of a crankshaft.

8 Claims, 2 Drawing Sheets

CRANKSHAFT AND PISTON ROD CONNECTION FOR A DOUBLE DIAPHRAGM PUMP

The invention relates to a double acting diaphragm pump (double diaphragm pump).

FIELD OF THE INVENTION

German patent application DE 32 06 242 discloses a double diaphragm pump having a piston centrally disposed in a housing and including a pump diaphragm mounted to each of its free ends and acting in a displacement space. The displacement spaces are connected via check valves to the suction manifold on the one hand and to the pressure manifold on the other hand. Furthermore there are provided means for alternatively pressurizing the pressure chambers for the flow medium on the sides of the diaphragm opposite to the displacement spaces. The diaphragms when they are alternatively pressurized by pressure air are moved in the same sense, with the pressure air displacing one diaphragm towards the product space and the flow medium towards the pressure manifold; while the other diaphragm performs a suction stroke. Accordingly the flow medium is displaced by pressure air so as to be pumped.

BACKGROUND OF THE INVENTION

Such pumps have various advantages. They are dry running safe and self-inducing. Also brief overloading thereof is not critical. No shaft seals and no rotating members in the product flow are required. Furthermore, the pump is not sensitive with respect to solids. Contaminants and solid materials can be conveyed in the product flow. Furthermore, displacement pumping of such a pump can be used also for shear-sensitive media. However, it is a drawback that, in particular at high pump pressures such as up to 6 bar, substantial compression power has to be available due to the compressibility of the air. This is why such diaphragm pumps are not economical at higher pressures.

From the brochure "Membranpumpen Typ Wiking M" of the firm Abel GmbH & Co. Pumpen- und Maschinenbau it becomes known to operate the diaphragm mechanically. A piston rod is connected to a yoke which is pivotally mounted to a link rod. However, the mechanical expenditure of such a pump is substantial. Furthermore, a single diaphragm pump generates strong pulsations and pumps only 50% of the pump rate of a double diaphragm pump at the same speed of the drives.

The problem to be solved by the invention is to provide a double diaphragm pump which is of simple structure and operates safely and which can be powered at high efficiency even at high pump pressures.

SUMMARY OF THE INVENTION

The problem just described is solved by a double diaphragm pump having flexible diaphragms disposed in displacement spaces and connected and mechanically coupled to piston rods, the displacement spaces being communicated via check valves to a suction manifold on the one hand and to a pressure manifold on the other hand, wherein each diaphragm is connected to a piston rod, which piston rods extend coaxially and are mounted on opposite sides to a guide frame having at least one lineal guide for a guide block which rotatably mounts a crank pin of a crank-shaft.

DETAILED DESCRIPTION OF THE INVENTION

The double diaphragm pump of the invention is provided with mechanically operated diaphragms. For transforming rotary movements into oscillatory movements of the diaphragms the invention provides a guide frame to which the piston rods connected to the diaphragms are mounted on opposite sides. Within the guide frame there is slidingly mounted a slide block and guided by means of a lineal guide. The slide block mounts the pin of a crankshaft which is connected to the drive motor. The lineal guide preferably comprises round rods.

The crank pin preferably is mounted in the slide block by antifriction bearings. The slide block is positively driven to by the rotary movements of the crank pin while maintaining their orientation due to the positive guide within the guide frame so as to perform reciprocatory movements along the guides. As a result the guides perform reciprocatory movements in the direction of the positively guided piston rods. This results in a mechanically simple, low friction transformation of the rotary movements of the drive motor to the linearly displaceable piston rods. The slide block is preferably guided by plastic bearings just as the piston rod is guided in respective guide bores of the housing.

In an embodiment of the invention the diaphragms are in the shape of a spherical cap. This shape ensures that, during the diaphragm strokes, there will be no folds in the diaphragm which otherwise may eventually cause damage.

The invention provides a double diaphragm pump which operates at high efficiency even at high pressures due to the mechanical positive guiding means. It can be operated along substantially constant characteristic curve, comparable to piston pumps even though there are certain limitations due to the resiliency of the diaphragms. Accordingly the pump of the invention is able to pump a flow medium at a predetermined pump rate and at a predetermined pressure. It is of small dimensions and may be operated with minimal noise.

The housing of the pump can be made of various materials such as aluminium, cast iron or special steel depending on the conditions of use. It is also possible to use a plastic housing, for example of polypropylene, polytetrafluorethylene, polyvinylidenfluoride or the like. In order to protect the diaphragms from abrasive and agressive media, coating of PTFE foils may be provided. Such a diaphragm has become known from German utility model G 84 32 204.5.

The invention will be explained in more detail with reference to drawings.

Figure 1:
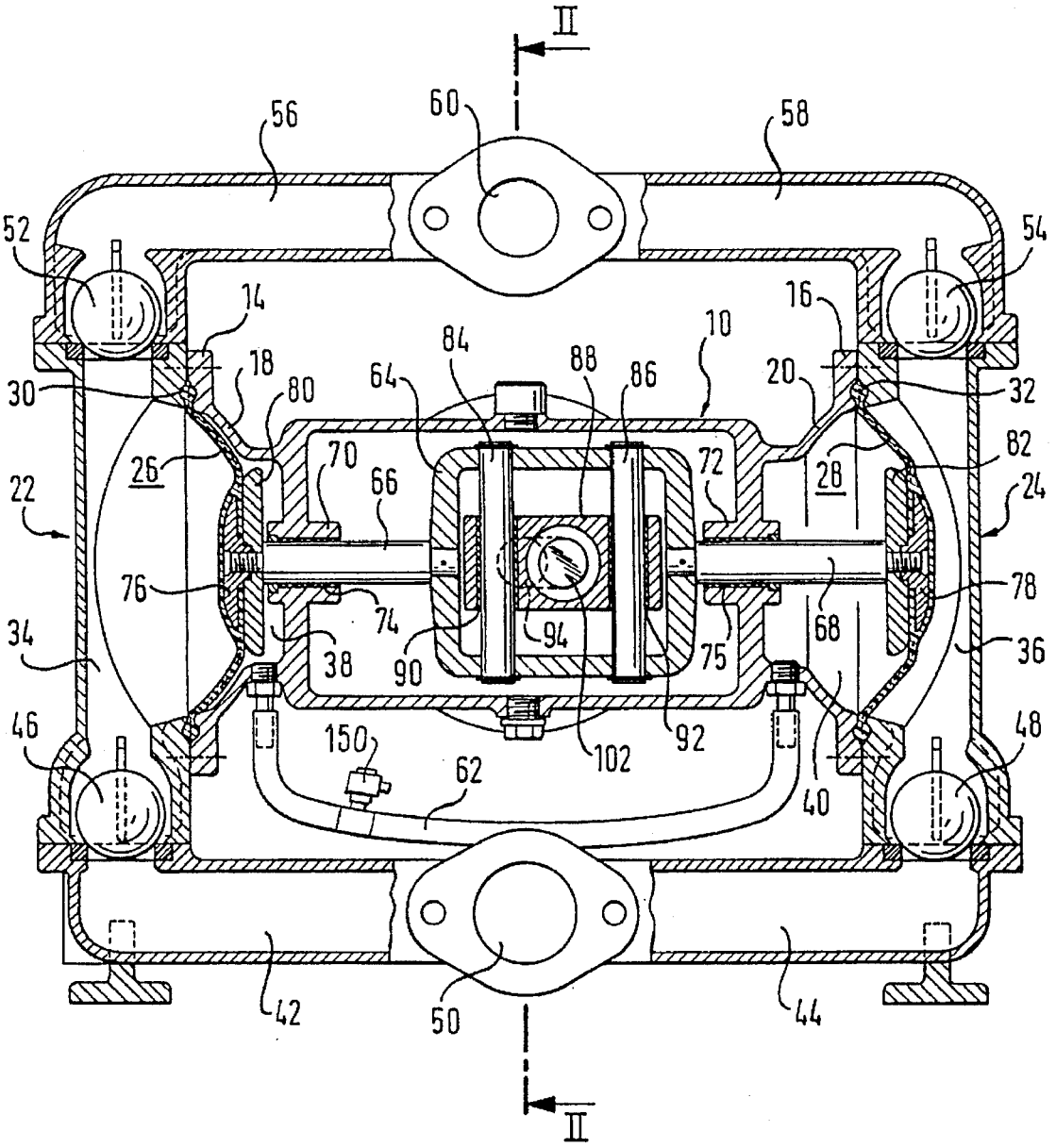
FIG. 1 is a section of a double diaphragm pump of the invention.
Figure 2:
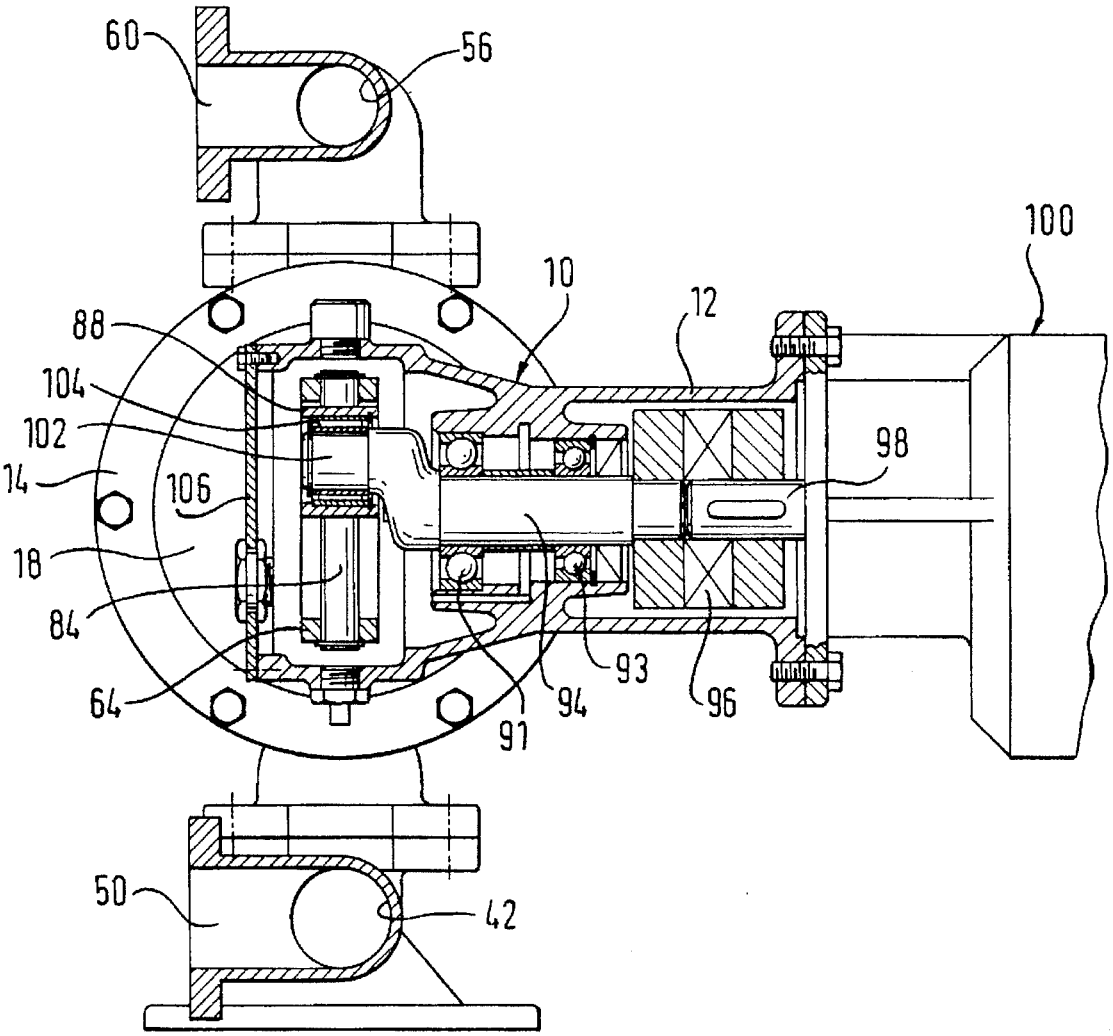
FIG. 2 is a section along line 2—2 in FIG. 1.

The double diaphragm pump shown in FIGS. 1 and 2 includes a first housing section 10 which is of box shape and has a tubular extension 12 on one side. The section 10 and the extension 12 are integrally formed, for example from cast aluminium, cast iron, special steel or the like. Integrally formed with the housing section 10 are flanges 14, 16 which are connected to the faces of the housing section 10 by slightly spherical wall portions 18, 20. The flanges 14, 16 have associated therewith circular diaphragm housing sections 22 and, respectively, 24 which are bolted to the flanges 14, 16. Diaphragms 26 and 28 are clamped between these components and are at their peripheries of O-ring-like cross-section as indicated at 30 and 32, respectively. They are received in corresponding annular grooves in flanges 14, 16 and, respectively, housing sections 22, 24 so that the diaphragms 26, 28 are safely held.

The diaphragms 26, 28 are made of a suitable elastomer and can be coated by PTFE towards dispacement spaces 34 and 36, respectively. Furthermore they are enforced by woven material inserts. The diaphragms 26, 28 are approximately in the shape of spherical cabs. As a result they do not form any folds during their strokes.

As already mentioned the diaphragms 26, 28 divide the interior of the diaphragm housing sections 22, 24 into a displacement space 34, 36 and a compensation space 38 and 40, respectively. The displacement spaces 34, 36 communicate with a suction manifold 50 via respective conduit portions 42, 44 and ball check valves 46, 48. Furthermore they communicate with a pressure manifold 60 via ball check valves 52, 54 and conduit portions 56, 58. The compensation spaces 38, 40 communicate with each other via a communication line 62.

The housing section 10 receives an approximately rectangular guide frame 64 to which are mounted piston rods 66, 68 on opposite ends. The piston rods extend through slide bearings 70, 72 of the housing section 10, which are provided with plastics sleeves 74, 75. At their ends the piston rods 66, 68 are connected to the diaphragm 26 and 28, respectively. To this end a plate 76 and 78 bolted to the piston rod 66, 68 is vulcanized into the central portion of the diaphragm 26, 28. Furthermore a disk 80 and 82 which has a rounded periphery is disposed between a shoulder of the piston rod 66, 68 and the diaphragm portion whereby the respective diaphragm portion is safely clamped therebetween.

In the guide frame 64 there is mounted a pair of spaced and parallel round rods 84, 86. They are made of a suitable material available as rod stock. The guide rods 84, 86 extend through guide bores of a slide block 88. The guide bores are provided with plastics sleeves 90 and 92, respectively.

As may be seen from FIG. 2 a crankshaft 94 is rotatably mounted in the extension 12 by means of antifriction bearings 91, 93. The crankshaft 94 is drivingly connected, via a clutch 96, to a drive shaft 98 of a not shown electric motor 100. A pin 102 of the crankshaft 94 is mounted by means of an antifriction bearing 104 in a central throughbore of the slide block 88.

For improvement of access the housing section 10 is closed at the face of the crankshaft 94 by a plate 106 which can be removed.

When the crankshaft 94 is driven, the slide block 88 is positively driven. It performs an orbiting movement, retains, however, its orientation due to being positive guided along the guide rods 84, 86. The guide frame 84 itself is positively guided by the piston rods 66, 68. As a result the rotary movements of the crankshaft 94 are transformed into reciprocatory movements of the piston rods 66, 68. The stroke of the piston rods 66, 68 and accordingly that of the diaphragms 26, 28 is determined by the length of the crankarm. When it is intended to change the stroke, another crankshaft 94 is to be used.

At the end of the suction stroke at the left hand side in FIG. 1, the displacement space 34 is of maximal volume. The diaphragm 26 is adjacent the housing section 18, however, does not engage the latter. Engagement should be avoided if possible because it could result in damages of the diaphragm. The diaphragm 28 has reached the dead center of its pressure stroke.

By means of a suitable sensor, such as a pressure sensor, the side of the diaphragm 26, 28 remote from the displacement space 34, 36 can be monitored in order to detect a hole or fissure of the diaphragms in time. Such a pressure sensor can be connected to the communication line 62.

I claim:

1. A double diaphragm pump having flexible diaphragms disposed in displacement spaces and connected and mechanically coupled to piston rods, the displacement spaces being communicated via check valves to a suction manifold on the one hand and to a pressure manifold on the other hand, wherein each diaphragm (26,28) is connected to a piston rod (66,68), which piston rods extend coaxially and are mounted on opposite sides to a guide frame (64) having at least one lineal guide (84,86) for a guide block (88) which rotatably mounts a crank pin (102) of a crankshaft (94), the lineal guide comprising round rods (84, 86) for engagement with corresponding guide bores (90, 92) of the guide block.

2. A double diaphragm pump according to claim 1, wherein said guide bores in the guide block (88) are provided with plastic sleeves (90,92).

3. A double diaphragm pump according to claim 1, wherein the piston rods (66,68) are slidingly and sealingly mounted in plastic sleeves (74) of the housing (10).

4. A double diaphragm pump according to claim 1, wherein the guide frame (64) is mounted in a closed housing section (10) comprising a lateral extension (14) receiving bearings (90,92) for said crankshaft (94).

5. A double diaphragm pump according to claim 1, wherein the diaphragms (26,28) are substantially in the form of spherical caps.

6. A double diaphragm pump according to claim 1, wherein each of said piston rods (66,68) is connected to a plate (76,78) vulcanized into the associated diaphragm (26, 28) and the diaphragms (26,28) each are fixed between its respective plate (76,78) and a disk (80,82) mounted on the respective piston rod (66,68).

7. A double diaphragm pump according to claim 1, wherein the sides of the diaphragms (26,28) remote from their respective displacemt space (34,36) are communicated to each other via a communication line (62).

8. A double diaphragm pump according to claim 1, wherein the sides of the diaphragms remote from their respective displacement spaces (34,36) are monitored via a pressure sensor.

* * * * *

UNITED STATES PATENT AND TRADEMARK OFFICE
CERTIFICATE OF CORRECTION

PATENT NO. : 5,649,809

DATED : July 22, 1997

INVENTOR(S) : VOLKER STAPELFELDT

It is certified that error appears in the above-identified patent and that said Letters Patent is hereby corrected as shown below:

Col. 1, line 3, FIELD OF THE INVENTION should be correctly shown after the title of the patent.

Col. 1, line 25, BACKGROUND OF THE INVENTION should be correctly shown after the first paragraph of the patent.

Col. 4, line 8, 150 should be inserted after the word "sensor".

Signed and Sealed this

Second Day of December, 1997

*Attest:*

Bruce Lehman

BRUCE LEHMAN

*Attesting Officer*

*Commissioner of Patents and Trademarks*